United States Patent [19]

Smith

[11] 4,299,059

[45] Nov. 10, 1981

[54] THERMALLY INSULATED, FIRE RESISTANT ATTIC DOOR

[75] Inventor: William V. Smith, Columbus, Ohio

[73] Assignee: Cardinal Industries, Inc., Columbus, Ohio

[21] Appl. No.: 128,520

[22] Filed: Mar. 10, 1980

[51] Int. Cl.[3] ..... E05D 7/00

[52] U.S. Cl. ..... 49/401; 49/485; 49/501; 49/37; 182/47; 182/81

[58] Field of Search ..... 49/488, 485, 401, 501, 49/37, 479; 182/47, 78, 81; 52/785, 811

[56] References Cited

U.S. PATENT DOCUMENTS

| | | | |
|---|---|---|---|
| 2,649,237 | 8/1953 | Bjorklund et al. | 49/37 X |
| 3,164,869 | 1/1965 | Barkan | 49/401 X |
| 3,299,574 | 1/1967 | Alexeff et al. | 49/401 |
| 3,312,030 | 4/1967 | Gillespie | 52/811 |
| 3,654,067 | 4/1972 | Klein | 52/785 X |
| 3,886,686 | 6/1975 | Urbanick | 49/488 |
| 3,943,663 | 3/1976 | Jechen et al. | 49/488 |
| 4,165,591 | 8/1979 | Fitzgibbon | 52/785 X |

*Primary Examiner*—Philip C. Kannan
*Attorney, Agent, or Firm*—William Rambo

[57] ABSTRACT

A ceiling-mounted attic door features a continuous outer panel of flame-resistant plaster board, an intermediate layer of thermal insulating material and marginal sealing gaskets and insulating strips arranged to thermally seal the marginal edges of the door when it occupies a normally closed position within its associated door opening.

2 Claims, 5 Drawing Figures

THERMALLY INSULATED, FIRE RESISTANT ATTIC DOOR

BACKGROUND OF THE INVENTION

The present invention relates generally to door construction, and more specifically to an improved, thermally insulated ceiling-mounted door which may be used to support a set of ladder-like folding steps or stairs.

In the past, ceiling-mounted traps doors have been constructed primarily with a view toward providing an efficient and easily operable support for a folding ladder or stair steps, and very little, if any, consideration has been given to the asthetic, fire resistive, or thermal insulating qualities of such doors. Lately, of course, the ability of a dwelling to retain heat in the winter and cool air in the summer has become a prime consideration in the building industry. Furthermore, it has long been known that if a fire breaks out in the lower living quarters of a dwelling, an opening into an attic may act as a flue and rapidly propagate and spread flames throughout the entire dwelling. Consequently, there is a need for an attic trap door which is tightly sealed in its closed position, which is flame resistant and which possesses good thermal insulating qualities, but which is light enough in weight to be maintained in a closed position by the normal counterbalance springs associated with a conventional folding ladder or stair.

SUMMARY OF THE INVENTION

The present invention provides an improved, flame-resistant, thermal insulating door which may be mounted, in association with a folding ladder or stairs, within a framed ceiling opening. The door comprises a generally open, marginal support frame which contains and supports within its confines one or more layers of a non-combustible thermal insulating material, such as glass fiber-reinforced urethane foam, and an outer panel of flame-resistant plaster (gypsum) board carried on and completely covering the outer face of the support frame and the insulating material. The outer side and end edges of the support frame are also covered with strips of flexible, flame resistant, fibrous glass insulation arranged to fill any gaps between the outer marginal edges of the door and the associated door frame, and a metal trim strip is also carried on the marginal edges of the door in position to overlap and cover any gaps or clearance spaces between the edges of the door and the door frame when the door occupies a closed position.

The primary object of the present invention is to provide a ceiling-mounted attic or trap door which is attractive in appearance, but which provides an efficient fire-resistive and thermal insulating barrier between the lower living quarters and the attic or upper storage area of a dwelling.

DESCRIPTION OF PREFERRED EMBODIMENT

Figure 1:
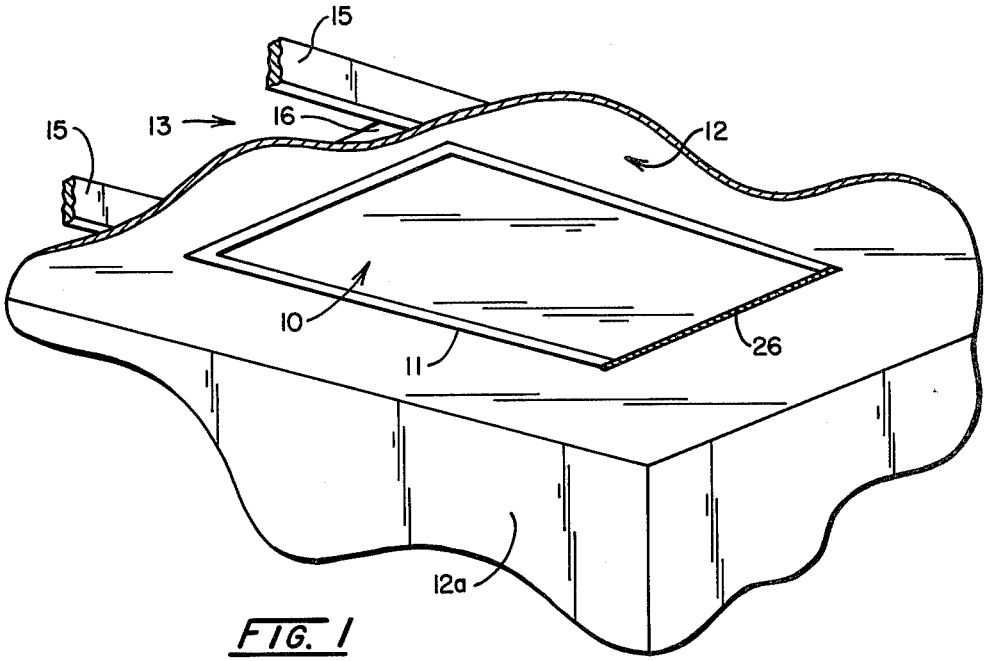
FIG. 1 is a fragmentary perspective view of an attic door according to this invention mounted in the ceiling of a room and occupying its normally closed position.
Figure 2:
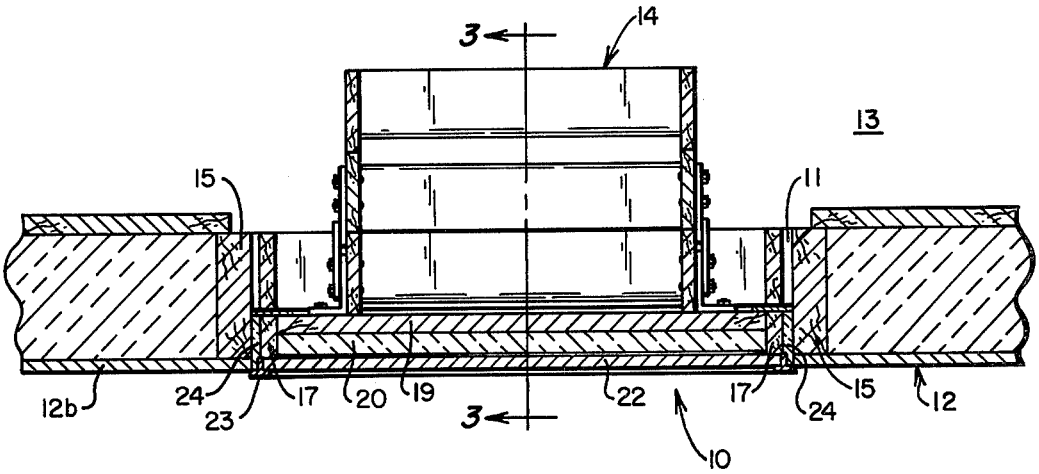
FIG. 2 is a transverse vertical sectional view of the attic door and associated folding ladder and taken approximately along line 2—2 of FIG. 3.
Figure 3:
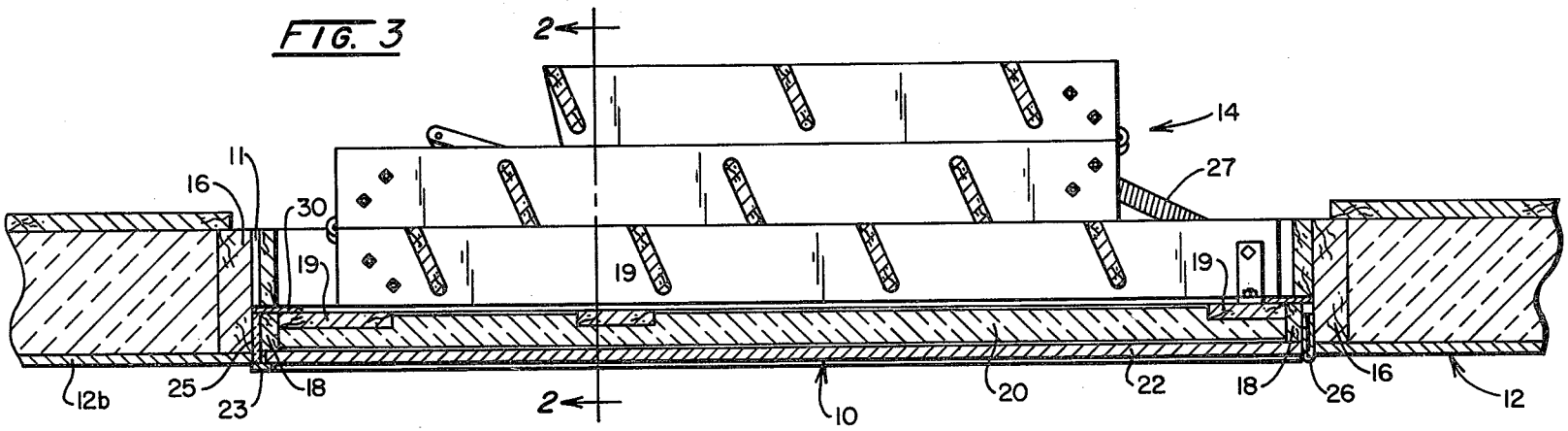
FIG. 3 is a longitudinal sectional view taken along line 3—3 of FIG. 2.

With reference to FIG. 1 of the drawings, the present trap door 10 is shown in its normally closed position within a rectangular opening 11 formed in the ceiling 12 of a room 12*a*, or other space, within a house or building. Advantageously, the door opening 11 may provide access to an attic or storage loft 13 above the ceiling 12. If desired, the door 10 may be used to support a conventional, spring-counterbalanced, folding stair or ladder indicated generally at 14 in FIGS. 2 and 3. The door 10 is connected for downward pivotal swinging movement from one end of the ceiling opening 11 to an open position providing access to the ladder 14 and to the attic or loft 13, as will be hereinafter described in more detail.

Figure 4B:
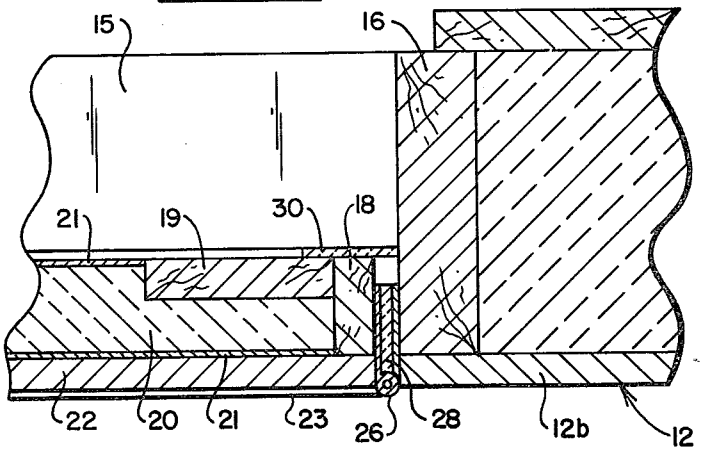
FIG. 4B is a sectional view similar to FIG. 4A, but taken through the hinged end section of the door and the adjacent portion of the ceiling structure.
Figure 4A:
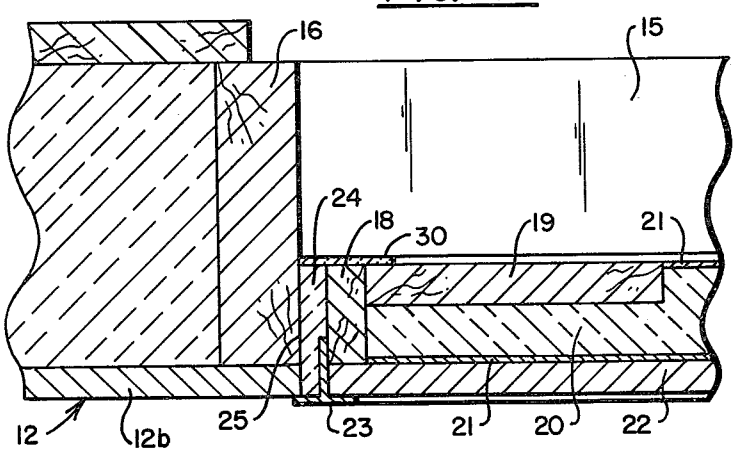
FIG. 4A is an enlarged, detailed vertical sectional view taken through the movable end portion of the attic door and the adjacent portion of the ceiling structure, with the folding ladder removed.

The ceiling opening 11, in the usual manner, is defined and framed by longitudinal joists 15 and transverse beams or cross members 16 which form a part of the ceiling structure 12. The door 10 comprises a rectangular border frame made up of relatively spaced, parallel longitudinally extending side members 17, transverse end members 18 and a plurality of transverse cross braces 19 rigidly joined to one another by screws or nails, not shown. Carried within the confines of the door frame between the side, end and cross members 17, 18 and 19, respectively, is a continuous layer or bat 20 of heat-resistant, thermal insulating material, such as fiber glass reinforced urethane foam. If desired, the layer or bat 20 of thermal insulating material may be covered on one or both faces thereof with sheets of heat-reflective aluminum foil 21 (see FIG. 4).

The trap door 10 further comprises an outer facing panel 22 composed of flame-resistant, gypsum or plaster board. The outer facing panel 22 may be rigidly secured in any suitable manner to the border frame of the door, such as by nails and/or adhesive, and the texture and appearance of the panel 22 preferably matches and harmonizes with the surrounding outer plaster layer 12*b* of the ceiling 12. An Inverted T-shaped, sheet metal molding strip 23 is secured along three sides of the border frame and overlies the adjacent marginal edges of the outer facing panel 22 of the door. A sealing strip 24 of flexible thermal insulating material, such as felted glass fibers is also secured along three sides of the border frame above the molding strip 23 to fill and thermally insulate the clearance space 25 normally present between the border frame of the door and the joists 15 and beams 16 of the ceiling structure.

An elongated, piano-type hinge 26 is connected between the inner end of the trap door frame and an adjacent cross beam 16 of the ceiling structure by means of screws, not shown. The trap door is thus supported for pivotal swinging movement between a generally horizontal, closed position, as shown in the drawings, and a generally vertically disposed, open position, not shown. Advantageously, the door 10 and the ladder 14 are lightly biased toward the closed position shown in the drawings by means of springs 27 which form a part of the folding ladder 14. It should be understood, however, that the parts of the ladder 14 are conventional and form no part of the present invention. If desired, a relatively thin strip 28 of flexible, thermal insulating may be attached to one of the leaves of the hinge 26 to fill and insulate the space between the leaves of the hinge when the door 10 occupies its closed position.

In operation, the door may be easily opened by grasping and pulling downwardly on a handle or cord, not shown, attached to the outer free end of the door. The ladder 14 may then be folded downward to an extended position to provide a stairway to the attic or loft 13. The door may be returned to its closed position simply by refolding the ladder 14 and swinging the free end of the door upwardly. When the door occupies a closed position, the outer facing panel 22 of gypsum or plaster board provides an excellent fire or flame-resistant barrier between the room 12*a* and the attic or loft 13 of the building, while the bat 20 and strips 24 and 28 of fibrous insulating material provide a thermally efficient insulation barrier between the room and attic. The edge sealing strips 24 and 28 of insulating material also provide an effective draft shield around the edges of the door, but if desired, a relatively thin gasket or weather strip 30 may also be applied to the upper marginal edges of the door frame in a position to overlie the strips 24 and 28 and wipingly engage the joists 15 and beams 16 to provide an additional draft seal around the trapdoor.

In view of the foregoing, it wil be seen that this invention provides an improved, thermally efficient, flame-resistant trap door construction for use in residential and other buildings. While a single preferred embodiment of the invention has been illustrated and described in detail, it will be understood that various modifications in details of construction and design may be made without departing from the spirit of the invention or the scope of the following claims.

I claim:

1. A flame-resistant, thermally insulated trap door for hinged mounting in a ceiling opening and comprising:

(a) a generally rectangular supporting frame;

(b) at least one layer of incombustible, thermal insulating material carried within and closing said frame;

(c) an outer facing panel of flame-resistant plaster board connected to one face of said frame in coextensive, covering relation to said frame and to said layer of thermal insulating material; and (d) a strip of flexible thermal insulating material positioned around the outer marginal edges of said frame for sealing engagement with the walls defining said ceiling opening.

2. A trap door according to claim 1 which further includes an inverted T-shaped, frame resistant trim strip carried at the marginal edges of said frame in overlying relation to the marginal edges of said outer facing panel and said strip of thermal insulating material and arranged to overlap the edges of the ceiling opening when said door occupies a closed position in said opening.

* * * * *